US009702549B2

(12) United States Patent
White et al.

(10) Patent No.: US 9,702,549 B2
(45) Date of Patent: Jul. 11, 2017

(54) TORCH WITH TWIST OPEN FIRE BOWL

(75) Inventors: Ron White, North Prairie, WI (US); Lars Hansen, Holstebro (DK)

(73) Assignee: Lamplight Farms Incorporated, Menomonee Falls, WI (US)

( * ) Notice: Subject to any disclaimer, the term of this patent is extended or adjusted under 35 U.S.C. 154(b) by 1444 days.

(21) Appl. No.: 13/482,651

(22) Filed: May 29, 2012

(65) Prior Publication Data

US 2013/0323659 A1 Dec. 5, 2013

(51) Int. Cl.

| | |
|---|---|
| ***F23D 3/18*** | (2006.01) |
| ***F23D 3/24*** | (2006.01) |
| ***F23Q 25/00*** | (2006.01) |
| *F23Q 2/32* | (2006.01) |

(52) U.S. Cl.

CPC ..... *F23D 3/18* (2013.01); *F23Q 25/00* (2013.01)

(58) Field of Classification Search

USPC ..... 431/320, 321, 363, 314, 313, 310, 301, 431/290, 126

See application file for complete search history.

(56) References Cited

U.S. PATENT DOCUMENTS

| | | | | |
|---|---|---|---|---|
| 203,043 A | | 4/1878 | Hillegass | |
| 243,134 A | | 6/1881 | Hinrichs et al. | |
| 401,075 A | | 4/1889 | Seltzer | |
| 1,554,130 A | * | 9/1925 | Sargeant | A01K 31/20 431/310 |
| 1,705,877 A | * | 3/1929 | Ramsey | F21V 37/00 362/161 |
| 2,122,624 A | | 7/1938 | Sauer | |
| 2,217,970 A | | 10/1940 | Shearman et al. | |
| 2,237,423 A | | 4/1941 | Freeman | |
| 2,313,784 A | | 3/1943 | Then | |
| 2,684,182 A | | 7/1954 | Gey | |
| 2,836,043 A | | 5/1958 | Spethmann | |
| 3,385,084 A | | 5/1968 | MacDonald | |
| 3,727,810 A | | 4/1973 | Douty | |

(Continued)

FOREIGN PATENT DOCUMENTS

| | | |
|---|---|---|
| CA | 2675817 | 10/2010 |
| WO | WO03106895 | 12/2003 |
| WO | WO2004108219 | 12/2004 |

OTHER PUBLICATIONS

Pipe-Line Denmark, "Elipse Advanced Burning Control".
Pipe-Line Denmark, "The Torch Master Brochure", Publisher: http://www.pipe-line.dk/pdf/English2007WEB.pdf.

*Primary Examiner* — Steven B McAllister
*Assistant Examiner* — Desmond C Peyton
(74) *Attorney, Agent, or Firm* — Gable Gotwals; David G. Woodral

(57) ABSTRACT

A torch has a fuel container with a reservoir and a top cover. The top cover defines a first wick passage, a first fill hole, and a guide slot. A fire bowl is positioned atop the fuel container and defines a second wick passage, a second fill hole, and a guide member. At least one open rotational position is allowed between the fuel container and fire bowl such that the first and second fill holes are aligned to allow fluid into the reservoir via the fill holes. At least one closed rotational position is allowed between the fuel container and the fire bowl such that the first and second fill holes are out of alignment substantially blocking fluid flow into or out of the reservoir via the fill holes.

21 Claims, 5 Drawing Sheets

(56) References Cited

U.S. PATENT DOCUMENTS

| | | | | |
|---|---|---|---|---|
| 4,792,054 | A * | 12/1988 | Weidman | B65D 55/02 220/253 |
| 5,269,432 | A * | 12/1993 | Beckertgis | B65D 47/265 215/250 |
| 5,405,262 | A | 4/1995 | Appel | |
| 5,555,993 | A | 9/1996 | Borkowski et al. | |
| 6,010,332 | A | 1/2000 | Lee et al. | |
| 6,468,071 | B2 | 10/2002 | Zou | |
| 6,482,365 | B1 | 11/2002 | Soller | |
| 6,520,770 | B2 | 2/2003 | Zou | |
| 6,631,852 | B1 | 10/2003 | O'Leary | |
| 6,739,471 | B2 | 5/2004 | Goetz et al. | |
| 7,156,653 | B1 * | 1/2007 | DeMars | F23D 3/32 431/321 |
| 2009/0068608 | A1 * | 3/2009 | Hansen | F23Q 25/00 431/320 |
| 2009/0220904 | A1 * | 9/2009 | Masterson | F23D 3/18 431/321 |
| 2009/0294553 | A1 | 12/2009 | Wang et al. | |
| 2010/0053935 | A1 | 3/2010 | Shen | |
| 2010/0104995 | A1 * | 4/2010 | Masterson | F23D 3/18 431/321 |
| 2010/0112503 | A1 | 5/2010 | Masterson | |
| 2011/0097676 | A1 * | 4/2011 | Masterson | F23D 3/18 431/320 |
| 2013/0027918 | A1 * | 1/2013 | White | F23D 3/18 362/157 |
| 2013/0288186 | A1 * | 10/2013 | White | F23D 3/26 431/2 |
| 2013/0288189 | A1 * | 10/2013 | White | F23D 3/04 431/310 |

* cited by examiner

TORCH WITH TWIST OPEN FIRE BOWL

FIELD OF THE INVENTION

This disclosure relates to decorative torches in general and, more specifically, to liquid fueled torches.

BACKGROUND OF THE INVENTION

Liquid fueled torches are utilized for a number of purposes such as lighting, decoration, and pest repellence. However, there is often some risk associated with refueling these torches. When the torch is required to be partially disassembled to refuel (e.g., removal of the top) there is a chance the pieces may be lost. Furthermore, this can be a dirty and cumbersome operation.

What is needed is a system and method for addressing the above, and related, issues.

SUMMARY OF THE INVENTION

The invention of the present disclosure, in one aspect thereof, comprises a torch having a fuel container with a reservoir and a top cover. The top cover defines a first wick passage, a first fill hole, and a guide slot. A fire bowl is positioned atop the fuel container and defines a second wick passage, a second fill hole, and a guide member. A wick holder passes through the first and second wick passages. The guide member fits into the guide slot to limit the degree of rotation between the fuel container and the fire bowl. At least one open rotational position is allowed between the fuel container and fire bowl such that the first and second fill holes are aligned to allow fluid into the reservoir via the fill holes. At least one closed rotational position is allowed between the fuel container and the fire bowl such that the first and second fill holes are out of alignment substantially blocking fluid flow into or out of the reservoir via the fill holes.

In one embodiment, the first and second fill holes are substantially the same size and the guide member and guide slot limit the rotation between the fire bowl and the top cover to a degree of rotation that is less than about three times an arc occupied by a fill hole. In another embodiment, the guide member and guide slot limit the degree of rotation between the fire bowl and the top cover to a degree of rotation about two times the size of the arc occupied by a fill hole.

The wick holder may be fixed to the top cover of the reservoir and protrude through the second wick passage into the fire bowl. The wick holder may provide a lip on a distal end thereof, with the lip retaining a captive biasing member that biases the fire bowl to the top cover. The fuel container may be rigidly affixed to an outer shell. Some embodiments will have a captive form fitting lid having a contour cooperating with at least a portion of the flame bowl such that the lid may be used as a snuffer. At least one magnet may be attached to the lid for retaining the lid against the fire bowl.

The invention of the present disclosure, in another aspect thereof comprises a torch with a substantially hollow torch body having an opening on an end thereof. The torch includes a fuel container having a reservoir and a top cover, the reservoir being disposed substantially within the hollow torch body and the top cover being rigidly affixed to the torch body proximate the opening therein. A fire bowl is atop the top cover of the fuel container. The fire bowl and top cover each provide a fill hole such that the holes may be rotated into alignment allowing for fluid communication into and out of the fuel reservoir and the holes may be rotated out of alignment to prevent fluid communication into and out of the fuel reservoir.

In some embodiments, the top cover defines a guide slot and the fire bowl defines a guide member such that the guide member fits within the guide slot and restricts the degree of rotation allowed between the fire bowl and the top cover. The torch may include a cap configured to fit the fire bowl to smoother flame. The cap may have at least one magnet for retaining the cap on the fire bowl. The torch body may be recessed proximate the opening thereof and the fire bowl may occupy at least a portion of the recess. The fire bowl may define a plurality of ventilation ports proximate the recess.

In other embodiments of the torch, the wick holder is retained by the top cover of the reservoir and protrudes through the fire bowl. The wick holder may also provide a lip on an end thereof terminating in the fire bowl. The lip may retain a biasing member that urges the fire bowl downward toward the top cover of the reservoir.

The invention of the present disclosure, in another embodiment thereof comprises a torch with a substantially hollow torch body having a round opening on a top thereof and having a toroidally defined recess relative to sides thereof around the top. A fuel container is within the hollow torch body having a fuel container top that is affixed to the opening of the torch body. The fuel container top provides a concave surface with a lipped wick passage proximate a center thereof, and defines a first fill hole and a guide slot both located radially away from the center. A fire bowl has a cooperating concave interior surface to substantially match the concave surface of the fuel container top, a conic edge that surrounds the recess defined in the torch body, a center wick passage, a second fill hole located radially away from the center wick passage, and a guide member located radially away from the center wick passage. The lipped wick passage interfits with the center wick passage to allow rotation between the fuel container top and the fire bowl. The first and second fill holes may be radially aligned to allow for fluid flow into and out of the fuel container, and may be radially misaligned to impede fluid flow into and out of the fuel container. A degree of rotation between the fire bowl and the fuel container top is limited by the distance the guide member travels within the guide slot.

Some embodiments of this torch include a wick holder traversing both wick passages, and providing friction retention of a wick that passes from the fire bowl to an interior of the fuel container. The wick holder may be affixed to the fuel container top with a biasing member interposing the wick holder and the fire bowl. The biasing member urges the fire bowl against the fuel container top. In some embodiments, the fire bowl defines a flat shelf and receives a snuffer cap thereon. The snuffer cap may affix to the flat shelf with at least one magnet and may also be tethered to the fire bowl. The fire bowl may define a plurality of perforations to serve as ventilation of the torch body.

DETAILED DESCRIPTION OF THE PREFERRED EMBODIMENTS

Figure 1:
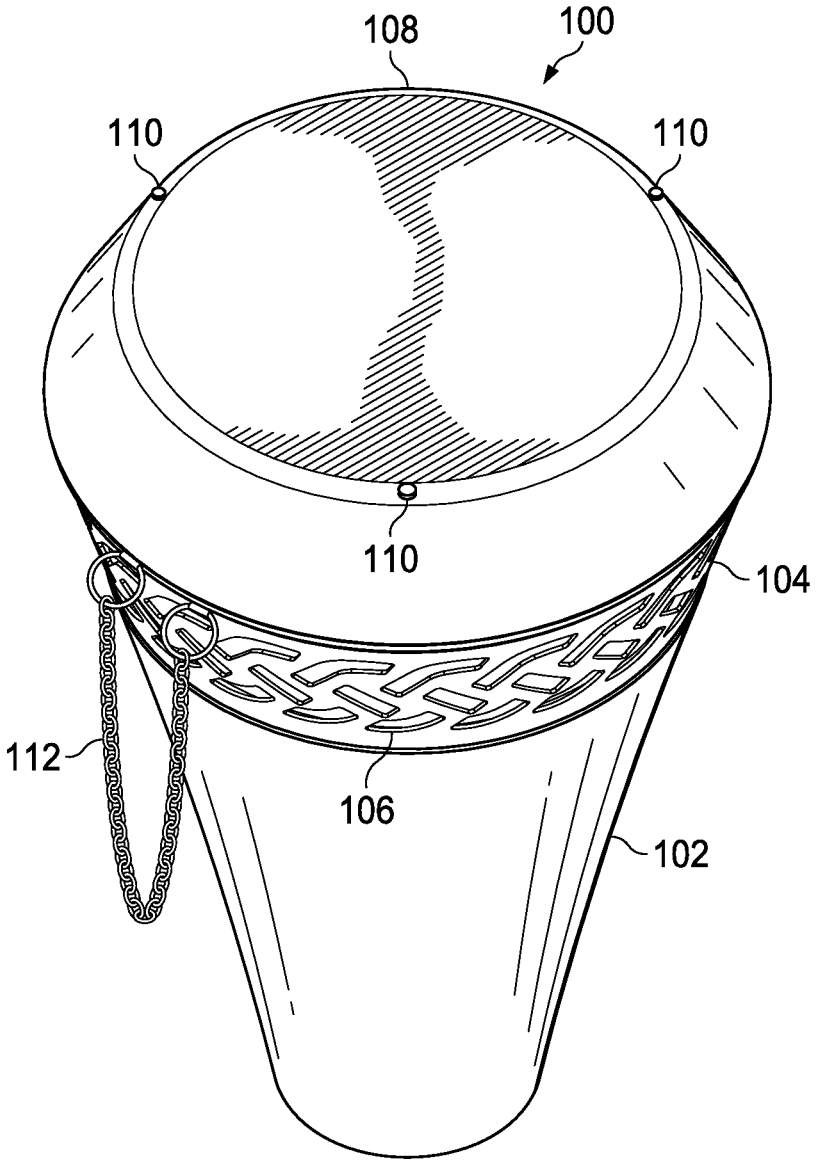
FIG. 1 is a perspective view of a torch with a twist open fire bowl according to aspects of the present disclosure.

Referring now to FIG. 1, a perspective view of a torch with a twist open fire bowl according to aspects of the present disclosure is shown. In the present embodiment, the torch 100 comprises a shell or body 102 which may be generally cylindrical or conic in profile. The body 102 may be made from a metal or polymer and may be configured to sit on a table top or attached to a pole for mounting into the ground. A fire bowl 104 integrates with the shell 102. The fire bowl 104 may be made from sheet metal or another material. A number of perforations 106 may be defined in the fire bowl 104. The perforations 106 may be decorative, but may also serve to provide ventilation and/or heat dispersal.

As will be described in greater detail below, the torch 100 may be opened or closed by rotation of the fire bowl 104 relative to the shell 102. In some embodiments, this is done by hand (e.g., no specialized tools or snuffer lids are needed). The fire bowl 104 and/or the perforations 106 thus provide a gripping surface for opening or closing the torch 100, while the shell 102 provides the counteracting gripping surface.

In the view of FIG. 1, a lid 108 sits atop the fire bowl 104. In some embodiments, the lid 108 also serves as a flame snuffer. The lid 108 may provide one or more magnets 110 integrated therewith to secure the lid 108 to the fire bowl 104. A chain 112 or other tethering device may serve to keep the lid 108 attached to the torch 100 when it is not being utilized as a snuffer or cap.

Figure 2:
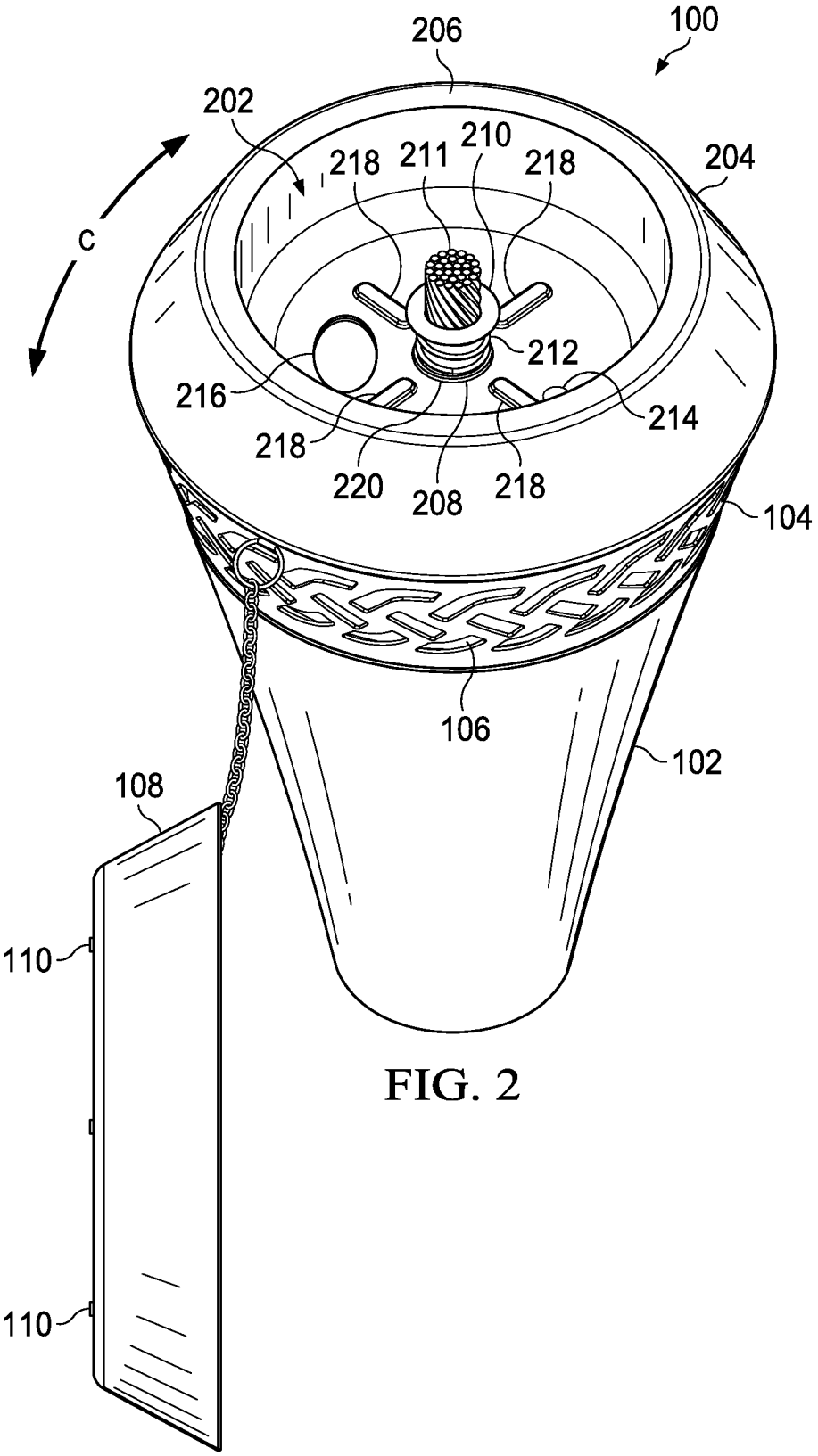
FIG. 2 is a perspective view of the torch of FIG. 1 with a lid removed.

Referring now to FIG. 2, a perspective view of the torch 100 of FIG. 1 is shown with the lid 108 removed. The fire bowl 104 can be seen to further comprise an interior 202 surrounded by a sloped edge 204. A flat shelf 206 may also be defined circumscribing the interior 202. In some embodiments, the flat shelf 206 provides a location for attachment of the magnets 110 of the lid 108. A wick holder 208 can be seen proceeding upward from the interior 202 of the fire bowl 104. In the present embodiment, a lip 210 protrudes laterally away from the wick holder 208. In the present embodiment, the lip 210 retains a biasing member 212 which presses downward against the interior 202 of the fire bowl 104. The full functionality of the wick holder 208 and biasing member 212 will be explained in greater detail below.

A number of other features are defined in the interior 202 of the flame bowl 104. For example, a guide member 214 may be formed as a depression in the surface of the interior 202. A fill hole 216 may also be provided for introducing liquid fuel into an interior of the torch 100. In some embodiments, the fire bowl 104 may be made from sheet metal or another relatively thin material. In such cases, one or more structural ridges 218 may be provided on the interior 202 in order to ensure that the fire bowl 104 retains the appropriate shape in light of twisting forces and the relatively high temperatures that may be encountered form operation of the torch 100.

In operation, the torch 100 may be placed in a closed configuration by rotating the fire bowl 104 relative to the shell 102. In the present embodiment, the fire bowl 104 rotates axially with respect to the shell 102 as shown by the arrow C. As will be explained in greater detail below, the fire bowl 104 may be rotated such that the fill hole 216 aligns with a second fill hole that provides for fluid access to an interior of the torch. When the filling operation is complete, the fire bowl 104 may be rotated such that the two fill holes are no longer aligned and thus flames or embers will be prevented from entering the fuel storage.

Figure 3:
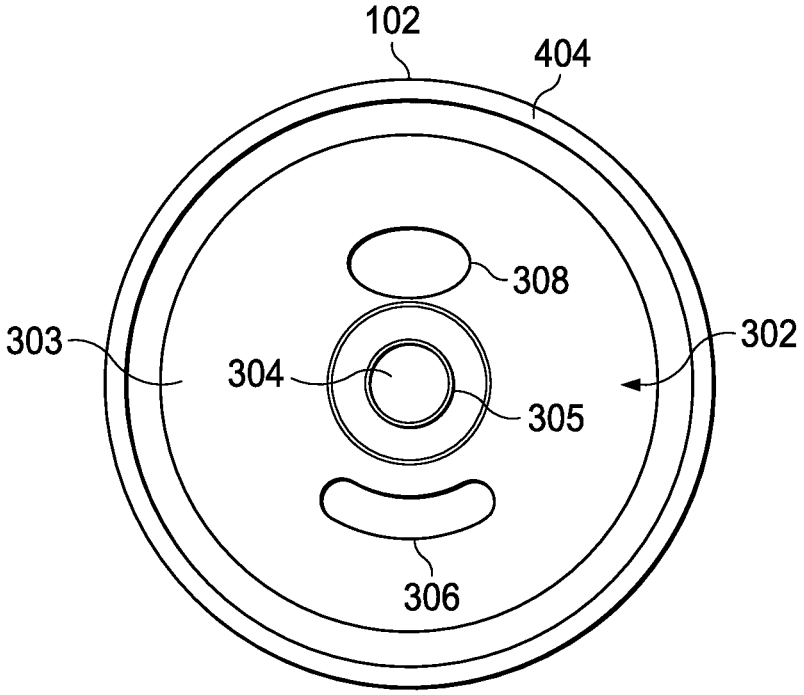
FIG. 3 is a top down view of the torch of FIG. 1 partially disassembled.

Referring now to FIG. 3, a top down view of the torch of FIG. 1 is shown. For purposes of illustration in this viewpoint, the fire bowl 104 has been removed. With the fire bowl 104 removed, a fuel container 302 may be seen situated within the shell 102. A top cover 303 of the fuel container 302 may substantially match the shape of the interior 202 of the fire bowl 104 (e.g., they may both have a concave shape). A wick passage 304 may be provided for passing the wick 211 into an interior of the fuel container 302. In the present embodiment, a lip 305 is provided surrounding the wick passage 304. A guide slot 306 is provided in the top cover 303 located radially away from the wick passage 304. In some embodiments, the guide slot 306 retains the guide member 214 of the fire bowl 104 to limit the degree of rotation between the fire bowl 104 and the shell 102. A second fill hole 308 is also provided in the top cover 303 of the fuel container 302. When this second fill hole 308 is aligned with the fill hole 216 of the fire bowl 104, fuel may flow freely into the fuel container 302. When the torch 100 is operational, the fire bowl 104 may be rotated such that the fill holes 308, 216 are not aligned.

An indentation or recess 404 can be seen circumscribing the fuel container 302. In the present embodiment, the recess 404 is uniform about the fuel container and can thus be considered a toroidal recess. The recess may be sized to correspond to a portion of the fire bowl 104 such that when the fire bowl 104 is attached to the shell 102 the sides of the shell 102 and fire bowl 104 present a smooth profile. The recess 404 also allows the interior 202 of the fire bowl 104 and the top cover 303 of the fuel container 302 to be reduced in size relative to the shell 102. This may be for aesthetic reasons or to control or reduce heat or burn rate.

Figure 4:
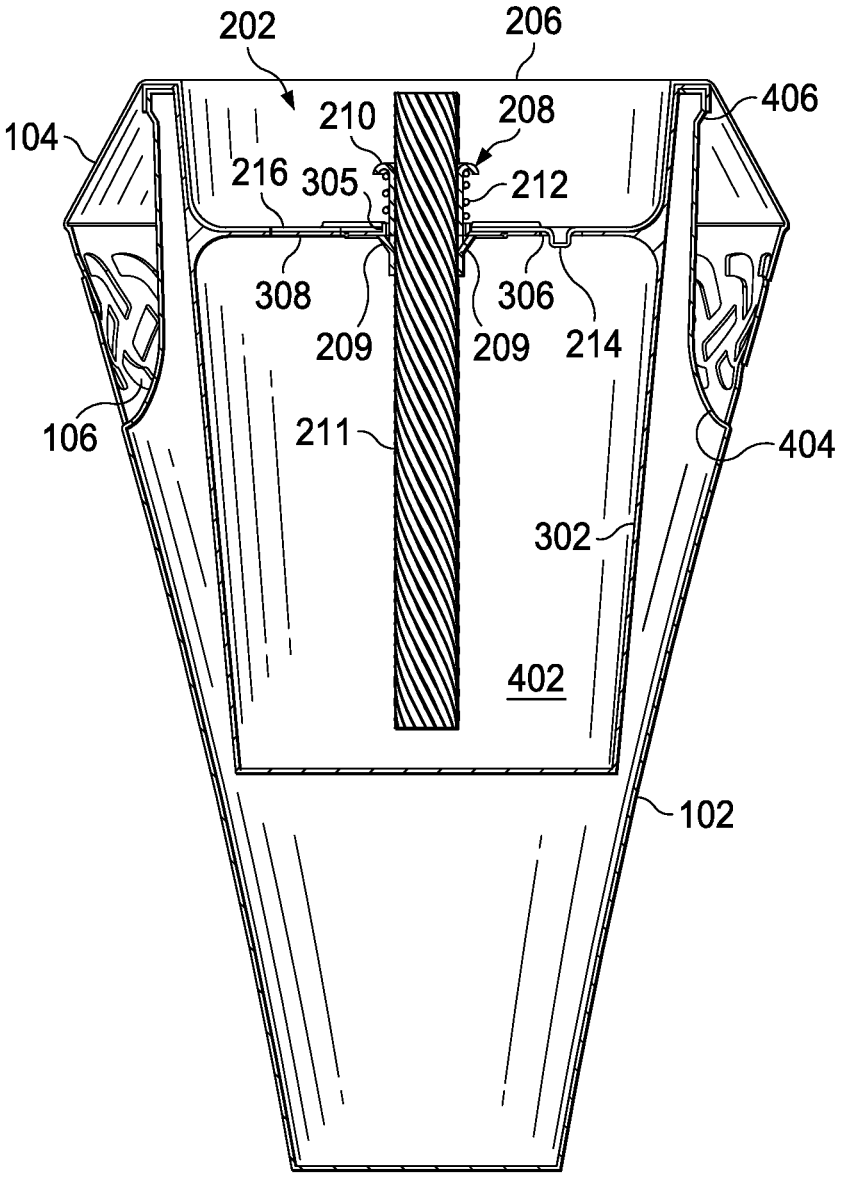
FIG. 4 is a side cutaway view of the torch of FIG. 1.

Referring now to FIG. 4, a side cutaway view of the torch of FIG. 1 is shown. In this viewpoint, the fire bowl 104 is shown attached to the shell 102 such that the relationship of the various components can be appreciated. In the view of FIG. 4, the fill holes 216, 308 are shown aligned such that a fuel reservoir 402 of the fuel container 302 can be filled. Here it can also be seen how the wick 211 passes from the fire bowl 104 to the wick holder 208 and into the fuel reservoir 402.

The wick holder 208 provides a plurality of retention clips 209 that retain the wick holder 208 in the wick passage 304. This prevents the wick holder 208 from being pulled completely of the passages 220, 304 out and into the fire bowl 104 by the biasing member 212. The retention clips 209 may be an interference fit clip. In another embodiment the clips 209 have a one way retention mechanism such that when the wick holder 208 is inserted into the wick passage 304, the clips 209 will expand and prevent its retraction. In other embodiments, the wick holder 208 may be integrated with, or otherwise permanently affixed to, the top cover 303 of the fuel container 302. The biasing member 212 is a coil spring in the embodiment of FIG. 4. However, the biasing member could also be a leaf spring or biasing device. The biasing member 212 may be made from metal or another heat resistant material.

The guide member 214 can be seen resting within the guide slot 306. As discussed, this limits the degree of rotation between the fire bowl 104 and the shell 102. The fuel container 302 is affixed to the shell 102 at the rim 406. In one embodiment, the fuel container 302 will be rolled into the rim 406 such that the fuel container 302 and the shell 102 are rigidly joined together.

FIG. 4 also illustrates the relationship of the recessed area 404 relative to the fire bowl 104. The fire bowl 104 fits partially into the recess 404 such that the exterior of the torch 100 is presents adjacent smooth surfaces that may be twisted by a user to open or close the torch 100 for filling. In order to reduce the temperature of the fire bowl 104, particularly where it may be touched by a user who is opening or closing the torch 100, the perforations 106 provide for ventilation and/or dispersion of heat.

Figure 5:
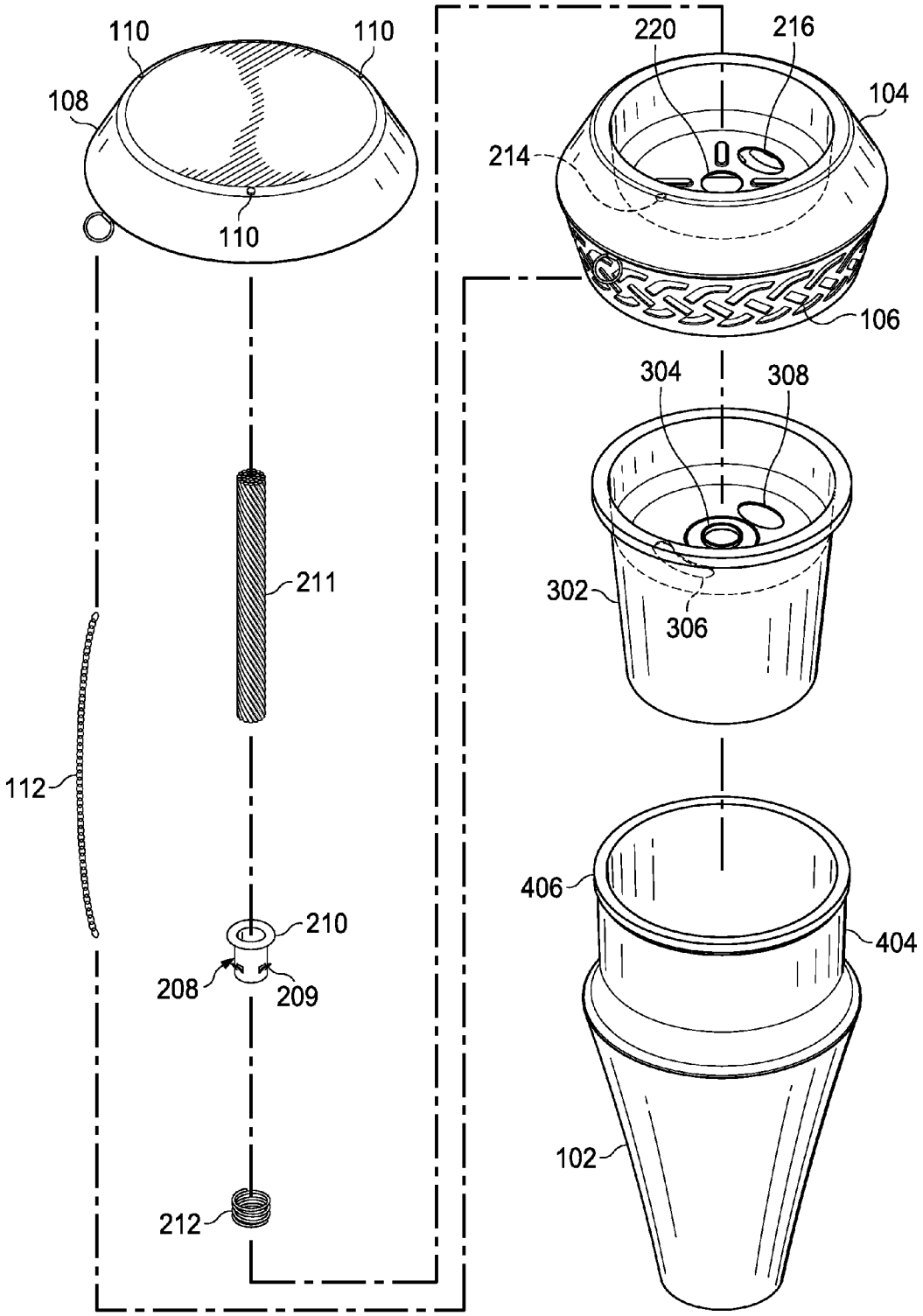
FIG. 5 is an exploded view of the torch of FIG. 1.

Referring now to FIG. 5, an exploded view of the torch of FIG. 1 is shown. In this view, the structure of the wick holder 208 is fully visible with the lip 210 on one end and the retainer clips 209 on an opposite end. It can also be appreciated how the wick passages 220 and 304 align to pass the wick 211 and wick holder 208.

During assembly, the fuel container 302 may be rolled, welded, or otherwise affixed to the rim 406 of the shell 102, thereby integrating the fuel reservoir 402 with the torch shell 102. The fire bowl 104 may be placed atop the torch 102 with the lip 305 providing alignment within the wick passage 220. The recess 404 on the torch body 102 will also serve to properly guide and align the fire bowl 104. When these pieces have been fitted together, the biasing member 212 may be placed upon the wick holder 208 and the wick holder 208 inserted through both wick passages 220 and 304, whereupon the retainer clips 209 will expand inside the fuel container 302, which will affix the fire bowl 104 to the shell 102. As previously described, the guide member 214 will ride within the guide slot 306 such that the degree of rotation between the fire bowl 104 and the shell 102 will be limited. In some embodiments, the degree of rotation allowed between the fire bowl 104 and the shell 102 will be roughly two to three times the radial distance occupied by one of the fill holes 216 or 308. In this way, the fire bowl 104 is allowed to rotate sufficiently to open and close the fuel reservoir 402, but is not allowed to completely rotate such that the user may have to make a long turn or rotation of the fire bowl 104 in order to fill the torch 100.

In some embodiments, the wick 211 will be a durable fiberglass wick with a long service life. The wick 211 may be retained by the wick holder 208 in a friction fit relationship. The wick 211 can be extended or retracted within the interior 202 of the fire bowl 104 in order to produce a larger or smaller flame. The flame produced by the wick 211 will be relatively large owing to the size of the interior 202 of the fire bowl 104. In order to safely and effectively extinguish an operational torch, the lid 108 may have a shape that fits the contour of the fire bowl 104 for use as a snuffer such that oxygen is effectively denied the flame. The tether 112 may affix the lid 108 to the fire bowl 104 such that when the lid 108 is not in use it will remain within easy reach and will not be subject to being lost.

* * *

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A torch comprising:

a fuel container having a reservoir and a top cover, the top cover defining a first wick passage, a first fill hole, and a guide slot;

a fire bowl atop the fuel container, comprising a bottom portion, the fire bowl bottom portion defining a second wick passage, a second fill hole, and a guide member the fire bowl being rotatable on the fuel container; and a wick holder passing through the first and second wick passages;

wherein the guide member fits into the guide slot to limit the degree of rotation between the fuel container and the fire bowl;

wherein at least one open rotational position is allowed between the fuel container and fire bowl such that the first and second fill holes are aligned to allow fluid into the reservoir via the fill holes; and wherein at least one closed rotational position is allowed between the fuel container and the fire bowl such that the first and second fill holes are out of alignment substantially blocking fluid flow into or out of the reservoir via the fill holes.

2. The torch of claim 1, wherein the first and second fill holes are substantially the same size and the guide member and guide slot limit the rotation between the fire bowl and the top cover to a degree of rotation that is less than about three times an arc occupied by a fill hole.

3. The torch of claim 2, wherein the guide member and guide slot limit the degree of rotation between the fire bowl and the top cover to a degree of rotation about two times the size of the arc occupied by a fill hole.

4. The torch of claim 1, wherein the wick holder is fixed to the top cover of the reservoir and protrudes through the second wick passage into the fire bowl providing a lip on distal end thereof, the lip retaining a captive biasing member that biases the fire bowl to the top cover.

5. The torch of claim 1, wherein the fuel container is rigidly affixed to an outer shell.

6. The torch of claim 1, further comprising a captive form fitting lid having a contour cooperating with at least a portion of the flame bowl such that the lid may be used as a snuffer.

7. The torch of claim 6, further comprising at least one magnet attached to the lid that retains the lid against the fire bowl.

8. A torch comprising:

a substantially hollow torch body having an opening on an end thereof;

a fuel container having a reservoir and a top cover, the reservoir being disposed substantially within the hollow torch body and the top cover being rigidly affixed to the torch body proximate the opening therein; and a fire bowl having a bottom portion atop the top cover of the fuel container the fire bowl being rotatable on the fuel container;

wherein a wick guide passing through the top cover of the fuel container and the bottom portion of the fire bowl; the fire bowl bottom portion and top cover each provide a fill hole such that the holes may be rotated into alignment by rotating the fire bowl, allowing for fluid communication into and out of the fuel reservoir and the holes may be rotated out of alignment to prevent fluid communication into and out of the fuel reservoir.

9. The torch of claim 8, wherein the top cover defines a guide slot and the fire bowl defines a guide member such that the guide member fits within the guide slot and restricts the degree of rotation allowed between the fire bowl and the top cover.

10. The torch of claim 8, further comprising a cap configured to fit the fire bowl to smoother flame and having at least one magnet for retaining the cap on the fire bowl.

11. The torch of claim 8, wherein the torch body is recessed proximate the opening thereof and the fire bowl occupies at least a portion of the recess.

12. The torch of claim 11, wherein the fire bowl defines a plurality of ventilation ports proximate the recess.

13. The torch of claim 8, wherein the wick holder is retained by the top cover of the reservoir and protrudes through the fire bowl.

14. The torch of claim 13, wherein the wick holder provides a lip on an end thereof terminating in the fire bowl, the lip retaining a biasing member that urges the fire bowl downward toward the top cover of the reservoir.

15. A torch comprising:

a substantially hollow torch body having a round opening on a top thereof and having a toroidally defined recess relative to sides thereof around the top;

a fuel container within the hollow torch body having a fuel container top that is affixed to the opening of the torch body, the fuel container top providing a concave surface with a lipped wick passage proximate a center thereof, and defining a first fill hole and a guide slot both located radially away from the center; and a fire bowl having a cooperating concave interior surface to substantially match the concave surface of the fuel container top, a conic edge that surrounds the recess defined in the torch body, a center wick passage, a second fill hole located radially away from the center wick passage, and a guide member located radially away from the center wick passage;

wherein the lipped wick passage interfits with the center wick passage to allow rotation between the fuel container top and the fire bowl;

wherein the first and second fill holes may be radially aligned to allow for fluid flow into and out of the fuel container, and may be radially misaligned to impede fluid flow into and out of the fuel container; and wherein a degree of rotation between the fire bowl and the fuel container top is limited by the distance the guide member travels within the guide slot.

16. The torch of claim 15, further comprising a wick holder traversing both wick passages and providing friction retention of a wick that passes from the fire bowl to an interior of the fuel container.

17. The torch of claim 16, wherein the wick holder is affixed to the fuel container top and a biasing member interposes the wick holder and the fire bowl, the biasing member urging the fire bowl against the fuel container top.

18. The torch of claim 15, wherein the fire bowl defines a flat shelf and receives a snuffer cap thereon.

19. The torch of claim 18, wherein the snuffer cap affixes to the flat shelf with at least one magnet.

20. The torch of claim 19, wherein the snuffer cap is tethered to the fire bowl.

21. The torch of claim 15, wherein the fire bowl defines a plurality of perforations to serve as ventilation of the torch body.

* * * * *